United States Patent [19]

Sprague

[11] Patent Number: 4,979,304

[45] Date of Patent: Dec. 25, 1990

[54] SHEET MATERIAL, CUTTER AND GUIDE

[75] Inventor: Russel C. Sprague, 4250 N. Coolidge, Harrison, Mich. 48625

[73] Assignees: Bradley J. Sprague, Harrison; Bruce Brewin, Novi, both of Mich.

[21] Appl. No.: 217,305

[22] Filed: Jul. 11, 1988

[51] Int. Cl.[5] ..... B26B 3/08

[52] U.S. Cl. ..... 30/293; 30/294; 33/32.3; 33/42

[58] Field of Search ..... 83/884, 885, 886, 745; 30/164.95, 292, 294, 293, 373; 33/32.1, 32.3, 42, 464, 479

[56] References Cited

U.S. PATENT DOCUMENTS

| | | | |
|---|---|---|---|
| 2,466,357 | 4/1949 | Beith | 33/42 |
| 2,473,189 | 6/1949 | Baker | 33/42 |
| 2,818,644 | 1/1958 | Crawford | 33/42 |
| 3,174,225 | 3/1965 | Abraham | 30/292 |
| 3,286,351 | 11/1966 | McAlister | 33/42 |
| 3,439,426 | 4/1969 | Wilson | 30/164.95 |
| 4,030,195 | 6/1977 | Insolio | 30/164.95 |
| 4,277,889 | 7/1981 | Oberg | 30/164.95 |

*Primary Examiner*—Hien H. Phan

*Attorney, Agent, or Firm*—Gifford, Groh, Sprinkle, Patmore and Sprinkle

[57] ABSTRACT

A T square shaped guide has a cutting device movable along its tongue section which is clamped at a desired distance from the head of the T square. Cutting is accomplished by movement of the T square with its clamped cutter along an edge of the material to be cut to a desired width. The cutting device employs cutting wheels arranged parallel to the T square head.

13 Claims, 2 Drawing Sheets

SHEET MATERIAL, CUTTER AND GUIDE

BACKGROUND OF THE INVENTION

I. Field of the Invention

The invention relates to devices used for cutting long sections of sheet material. Particularly material such as gypsum wall board which is relatively stiff and supplied usually in sections four feet wide and up to sixteen feet long. It is often necessary to cut sheets of this type into narrower sections for use in building construction. This is commonly accomplished by marking the boards using rulers, squares and other straight edges. It involves marking at several points down from the edge of the sheet, drawing straight lines along the material from marker to marker and then scoring the material with a knife along the lines. Lastly the desired panel is broken loose. The task requires using several "tools" consecutively picking up one, placing it down, then the other etc. The tools must be kept in hand and delays can be encountered when one of the several tools is missing or moved a distance away from the last.

II. Description of the Prior Art

U.S. Pat. No. 3,439,426 granted to R. Wilson Apr. 22, 1969 discloses a glass-cutting tool employing a T square. The tongue of the T square is bifurcated and a cutter head is slidable along the tongue to score the upper surface of a sheet of glass. In use the starting point of the score is located by use of a ruled head of the T square. The T square then is positioned with its head at the proper point and the cutter is slid along the tongue of the T square. This device does not provide a means for scoring an elongated sheet parallel to its edge as is needed for use in construction with material such as gypsum wallboard. It provides only for scoring laterally inwardly from an edge.

U.S. Pat. No. 4,030,195 granted June 21, 1977 to Thomas Insolio discloses a scoring device which is adapted for scoring sheets which rest on a table and wherein the tool has access to the table top surface on which the material lies. The tool comprises a cam plate which is a quadrilateral having four sides of unequal lengths. The cam is adapted to be slid along the table while it also slides along against the side edge of the sheet to be cut. A rod extends perpendicularly to the cam and carries a cutting tool which extends downwardly to cut the material as the tool is slid along. The height of the cutting tool above the surface of the table can be adjusted by rotating the cam. Since there are four edges to the cam i.e. four sides, there are four different heights at which the tool can be placed thus limiting the use of the tool. In Insolio a rod is positioned a substantial distance above the sheet to be scored and the cam-like block must be held against one edge of the material while it is also pressed down against the table at the same time in order to prevent canting of the cutting tool. The tool is likely to prove unstable particularly as the distance between the cutting edge and the cam block increases. The cutter depends downwardly from the elongated rod. In addition to the tendency of the rod to flex and the cam to sway the cutter does not provide stability longitudinally transverse of the single rod support. Thus flexing, bending and twisting leading to inaccuracies are a constant danger.

SUMMARY OF THE INVENTION

The instant invention provides a means for cutting and/or scoring small or relatively large sheets of material in an efficient, reliable, exact manner. According to the invention the cutter and guide provide a means for easily setting the correct line of cut based from an edge of a sheet. Further the invention provides a very stable cutting and/or marking tool. A shaped device having a head that can slide along an T-shaped of a sheet to be cut is employed which provides stability lengthwise the sheet and does not have to be pressed also against a table. In addition a stable tongue projects outwardly from the head and is of rigid material of a substantial width crosswise thus providing stability with respect to the tongue. Furthermore a cutter is employed which employs a pair of cutting wheels spaced on opposite sides of the tongue adding further to the stability. The cutting device can be readily adjusted lengthwise of the tongue to achieve an accurate cutting line and it can quickly and easily be locked at the chosen location. The paired cutters form leading and tracking cutters which not only further increases the stability of the bridging tongue but also increases the likelihood of cutting along the proper "line". Stability is enhanced by the beamlike support of the cutters in proximity to the face of the sheet to be cut, as well as by the tracking tendencies and resistence to skewing provided by the two spaced cutters bearing upon the sheet.

DETAILED DESCRIPTION OF THE PREFERRED EMBODIMENT OF THE INVENTION

Figure 1:
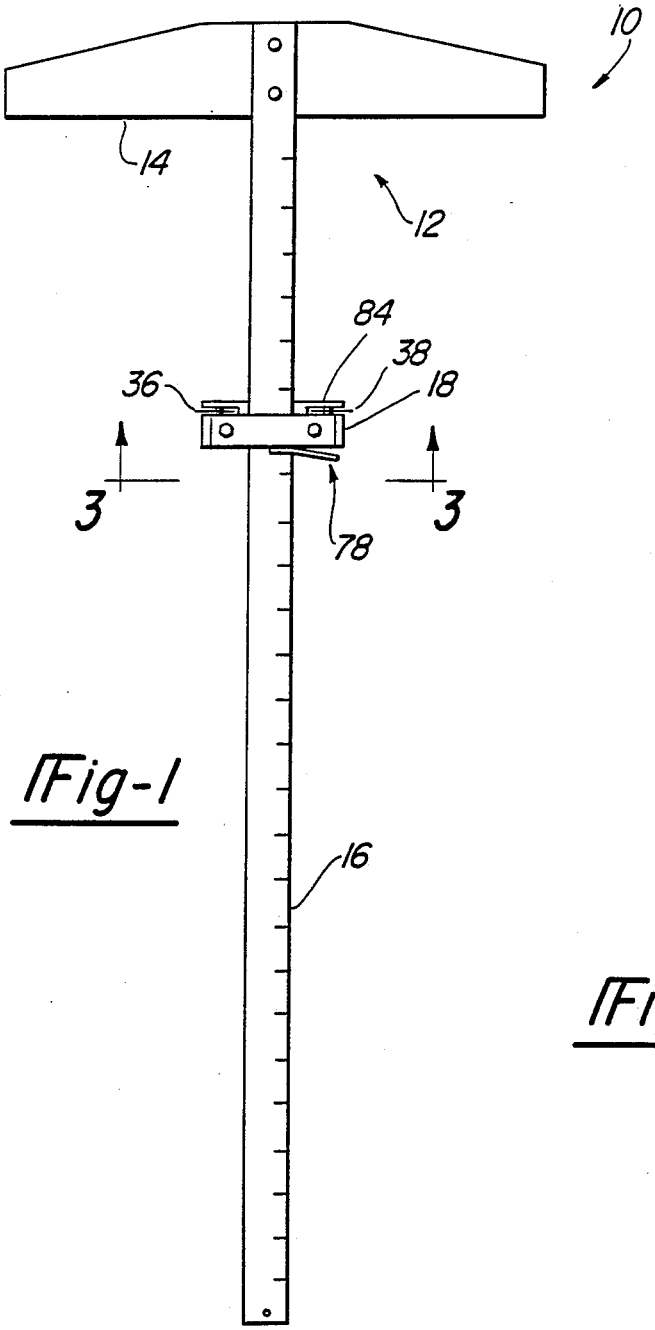
FIG. 1 is a top plan view of a tool structured according to the invention.
Figure 2:
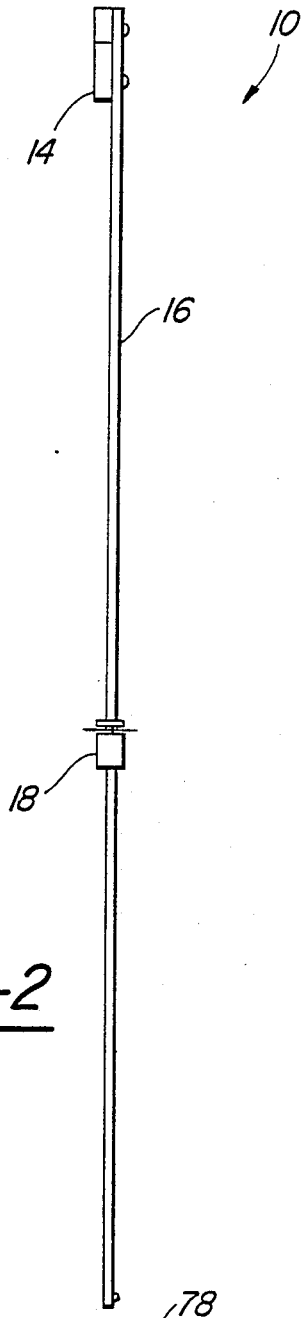
FIG. 2 is a side elevational view.
Figure 3:
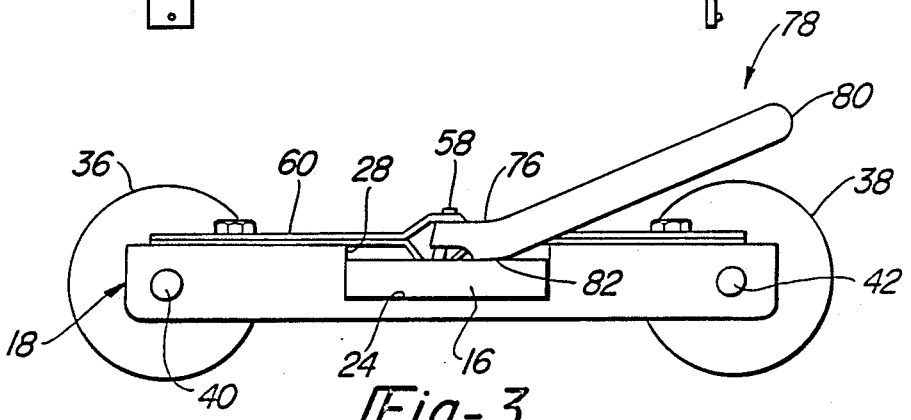
FIG. 3 is an enlarged elevational view partly in section taken along line 3—3 of FIG. 1 and showing a slide.
Figure 4:
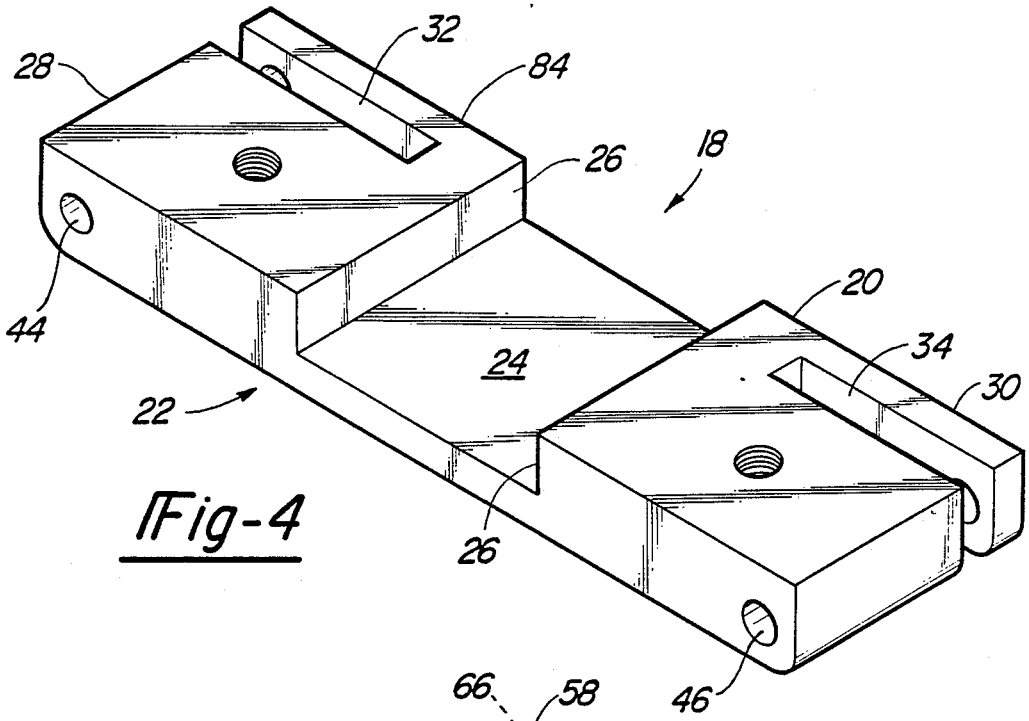
FIG. 4 is perspective view of the main frame of the slide of FIG. 3.

Referring now to the drawings:

In FIG. 1 the tool 10 is shown to comprise a T-square 12 having the usual head 14 and tongue 16. The tongue is provided with a series of ascending graduations. Upon the tongue 16 there is supported the slide 18 which can be moved longitudinally along the tongue. As shown in FIGS. 3 and 4 the slide consists of a main frame 20. Frame 20 has a central channel 22 provided with a base 24 and sidewalls 26 and 28. The dimensions of the sidewalls 26 and 28 and base 24 are such as to slidingly receive the tongue 16. The tongue 16 in the preferred form is constructed of rust resistent bar stock. The fit is such, and the length of the channel 22 transversely of slide 18, i.e. the width of the slide is such as to prevent canting yet permit movement of the slide 18 along the tongue. Furthermore the depth of the channel is such, as shown, so that tongue 16 can be recessed within the channel 22, see FIG. 3.

The main frame of slide 18 provides a pair of end sections 28 and 30. Each has an elongated slot 32 and 34 respectively extending vertically therethrough adjacent to one side of the frame. Slot 32 opens outwardly to one end of the frame while slot 34 opens out to the opposite end of frame 20. The slot are of a width and length to receive cutter wheel 36 and 38 respectively, FIG. 3. Shafts 40 and 42 support the cutters. The shafts are secured in openings 44 and 46 which extend transversely through the frame end sections including the outer legs of the slots 32 and 34. An interference fit is used to secure the shafts in the slide frame. The cutting wheels are of standard size, shape and construction as known in the art, and are such as are used presently in cutting wallbaord and the like.

Figure 5:
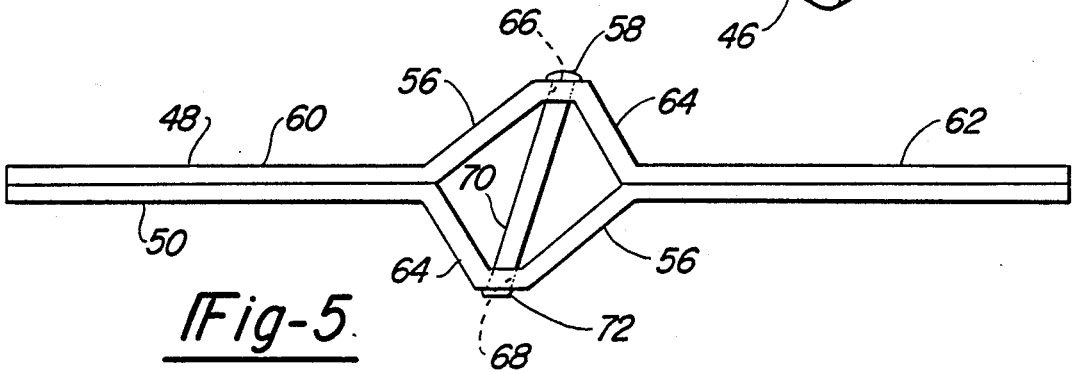
FIG. 5 is a side elevation of a lock support showing a lock pin fitted therein with its mating lock lever removed.
Figure 6:
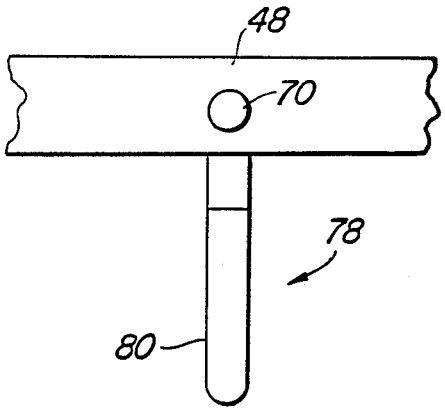
FIG. 6 is a top plan view of the support of FIG. 5 showing a lock lever member in association therewith.

Upon the upper surface of the frame 20, there is secured a pair of restraining members 48 and 50, FIGS. 3, 5 and 6. These members are secured to the frame by screws 52 and 54 with one restraining member overlapping the other. Members 48 and 50 are formed of steel in the preferred form shown and serve to support a locking means. The restraining members have centrally of their length offset portions formed, with respect to the upper of the two restraining members, by the upperwardly extending section 56, a median section 58, extending generally parallel to the major legs 60 and 62 of the restraining member, and a downwardly extending section 64. As shown in the drawings, the two restraining members actually have offset portions which are mirror images of each other. The two restraining members each also have slots 66 and 68 respectively which extend transversely through the median section thereof but at acute angles with respect to the horizontal plane of the two restraining members. The two restraining members are assembled by joining along their common faces with one offset portion facing downwardly and the other upwardly, FIG. 5. As a result, the two slots 66 and 68 are in alignment and provide an opening for receiving lock pin 70. The latter is force fit within the slot 66 and 68 and headed as well as at 72 to secure it in position. The pin 70 is actually inserted through an opening 74 in a flange 76 of a lock lever 78, FIG. 7, as the pin is passed from one slot 68 to the other thus securing the lever 78 to the pin. The association between the pin and lever is such that the lever can be rotated on the pin.

Figure 7:
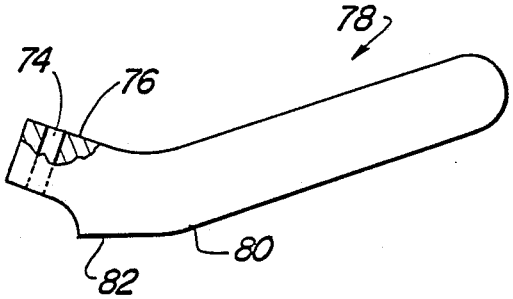
FIG. 7 is a partially sectioned side elevation of the lock lever member of FIG. 6.

The flange 76 is offset from the lever arm 80. Both arm 80 and flange 76 extend upwardly at acute angles from lock face 82, but generally lie in a common, substantially vertical, plane as shown in FIGS. 6 and 7. Lock face 81 is in the form of a flat surface on the bottom of lever 72 at approximately the juncture of flange 76 and lever arm 80. FIGS. 1 and 3 show the lock lever arm 80 extending adjacent the main frame 20 of the slide 18 with lock face 82 bearing against the upper surface of the tongue of bar rule 16 in such a manner as to lock the slide into position along the tongue. The lock face is substantially flat and extends substantially horizontally when in this position with the upper side of flange 76 bearing against the upper offset portion of the restraining members. The restraining members thus take the locking force and transmit this force to the main frame of the slide. When the lever arm is rotated to the position shown in FIG. 6 however, the cant of the pin 70 will cause the lever to rise from tongue 16 relieving the lock lever from the tongue. The slide can then be adjusted to a new position along the tongue and locked in the new position by a simple rotation of the lever 78.

As will be obvious to one skilled in the art, graduations are set in the tongue, bar rule, so that when the edge 84 of slide 18, FIGS. 1 and 4, is set at the selected cutting width the cutters will be at the indicated distance from the inner face 86 of the head 14. It will be noticed therefore that one only has to make the adjustment of the slide to the cut width desired and then place the head against the edge of material such as wallboard, press the slide downwardly onto the board face and move the tool along the edge to the desired length of cut. There is no longer a need to measure down from an edge at two or more places, then mark the spots, then draw a line using some form of straight edge as a guide between the marks and then pick up yet another tool to cut along the marked line.

Furthermore construction of the slide is such that the cutting wheels lie outwardly to opposite sides of the tongue. This provides great stability to the cutting operation as does the fact that the tongue is received within a channel of the slide. The forward wheel will make an initial cut as it moves along and within a few inches the following wheel will be riding in the same track giving further stability. One need only set the required width of cut, then place the head against the edge of the board with one hand, press the slide downwardly against the surface of the board sufficiently to cut into the board with the other hand and then move the head and cutter along to effect the desired cut.

Having described my invention, however, many modifications thereto will become apparent to those skilled in the art to which it pertains without deviation from the spirit of the invention as defined by the scope of the appended claims.

I claim:

1. A cutting tool for cutting sheet material comprising a T square having a head and a tongue extending at right angles to said head, a slide moveable along said tongue, means for locking said slide in selected positions along said tongue whereby said slide is fixedly positioned at a selected distance from said head, said locking means comprising a lever and a lock pin, said locking pin extending upwardly at an acute angle with respect to said tongue, said lever comprising a lever arm for rotating said lever on said pin and a locking face movable into locking engagement with said tongue when rotated in a first direction on said pin, but disengageable from said tongue when rotated in a direction opposite said first direction to unlock said slide.

2. The cutting tool of claim 1 including said slide having a channel comprising a base and sidewalls with an open upper surface, said channel closely fitting said tongue, said tongue being recessed in said channel beneath said upper surface of said slide.

3. The cutting tool of claim 2 including said outwardly extending portions of said slide each having a slot extending vertically therethrough longitudinally of the length of said slide and transversely of said tongue, a shaft extending transversely through each said slot, each said cutter wheel being rotatably supported on one of said shafts in a vertical position and being received within a respective said channel, with said cutting wheels being parallel to each other.

4. The cutting tool of claim 1 and including said lever being supported on said slide for movement, respectively, into a locking position in which said slide is locked in position on said tongue and to an unlocked position in which said slide can be moved along said tongue.

5. The cutting tool of claim 4 including said lever comprising a lock face, said lever lock face being movable into and out of engagement with said tongue for respectively locking and unlocking said tongue to said slide.

6. The cutting tool of claim 4 and including said lever being pivotably supported by said lock pin.

7. The cutting tool of claim 1 including said slide having portions extending outwardly from each said of said tongue transversely of said tongue, a cutter wheel rotatably supported on and depending downwardly from each of said portions about axes parallel to the length of said tongue and transversely of said head.

8. The cutting tool of claim 7 wherein said cutting wheels lie in a common plane extending vertically transversely of said tongue.

9. The cutting tool of claim 7 including said head having a surface extending beneath said tongue adapted to be placed against and slid along an edge of a sheet to be cut while both said cutter wheels are pressed against a face of said sheet and moved in unison with said head along said sheet.

10. A cutting tool for cutting sheet material comprising a T-square having a head and a tongue extending at right angles to said head, a slide movable along said tongue, means for locking said slide in selected position along said tongue whereby said slide is fixedly positioned at a selected distance from said head, restraining means forming a portion of said slide, said restraining means comprising a pair of oppositely extending offset portions forming an opening, a lock pin mounted in said offset portions and extending through said opening, said locking means comprising a lever supported on said lock pin, said offset portions each comprising a median section extending generally parallel to said tongue with one of said median sections being closer to one end of said slide than the other of said median sections and said lever being supported by each said median section for pivotal movement into and out of locking engagement with said tongue.

11. The cutting tool of claim 10 including said slide having portions extending outwardly from each side of said tongue transversely of said tongue, a cutter wheel rotatably supported on and depending downwardly from each of said portions about axes parallel to the length of said tongue and transversely of said head.

12. The cutting tool of claim 10 including said slide having a channel comprising a base and sidewalls with an open upper surface, said channel closely fitting said tongue, said tongue being recessed in said channel beneath said upper surface of said slide.

13. The cutting tool of claim 10 including said lock pin extending between and supported by both said offset portions, said lever being supported on said pin at an acute angle with respect to said slide.

* * * * *